US008678392B1

(12) United States Patent
Alhazza

(10) Patent No.: US 8,678,392 B1
(45) Date of Patent: Mar. 25, 2014

(54) CARD GAME AND METHOD FOR PLAYING THE SAME

(71) Applicant: Hebah Abdullah Alhazza, Qortuba (KW)

(72) Inventor: Hebah Abdullah Alhazza, Qortuba (KW)

( * ) Notice: Subject to any disclaimer, the term of this patent is extended or adjusted under 35 U.S.C. 154(b) by 0 days.

(21) Appl. No.: 13/961,859

(22) Filed: Aug. 7, 2013

(51) Int. Cl.
*A63F 1/00* (2006.01)

(52) U.S. Cl.
USPC ..... 273/292; 273/299; 273/302; 273/308; 463/12

(58) Field of Classification Search
USPC ..... 273/292, 297–308; 463/12
See application file for complete search history.

(56) References Cited

U.S. PATENT DOCUMENTS

| | | | | | |
|---|---|---|---|---|---|
| 1,215,657 | A | | 2/1917 | Hicks | |
| 1,600,108 | A | * | 9/1926 | Gell | 273/292 |
| 1,982,534 | A | * | 11/1934 | Parker | 273/306 |
| 4,428,582 | A | | 1/1984 | Smith | |
| 4,795,161 | A | * | 1/1989 | Chao | 273/292 |
| 4,807,885 | A | * | 2/1989 | Chamblee et al. | 273/292 |
| 5,026,072 | A | | 6/1991 | Ayisi | |
| 5,163,688 | A | * | 11/1992 | Simms | 273/298 |
| 5,497,999 | A | | 3/1996 | Stewart et al. | |
| 5,568,924 | A | * | 10/1996 | Katsuren | 273/292 |
| 5,863,040 | A | | 1/1999 | Van Gass | |
| 6,651,984 | B1 | | 11/2003 | Luken | |
| 7,988,153 | B2 | * | 8/2011 | Chang | 273/304 |
| 8,328,197 | B2 | | 12/2012 | Jones | |
| 2004/0066002 | A1 | * | 4/2004 | Spring | 273/298 |

OTHER PUBLICATIONS

Target Brands, Inc. (n.d.) Phase 10 Card Game. *Toys: Games & Puzzles: Card Games*. Retrieved on Mar. 7, 2013 from http://www.target.com/p/phase-10-car-d-game/-/A-14078534#?lnk=sc_qi_detailbutton.

* cited by examiner

*Primary Examiner* — Benjamin Layno
(74) *Attorney, Agent, or Firm* — Richard C. Litman

(57) ABSTRACT

A card game and methods for playing a card game are provided played by a plurality of players. A pre-determined number of cards are included in the card deck of the card game. Upon a determination of a dealer, a preset number of cards from the card deck are dealt to each player. Each card has a face with a number, picture/icon, special character, or combination number with picture/icon. An object of embodiments of the card game is to gain a pre-determined total of points, a designated winning sum, based on the numeric value of cards of a player with consideration to the operations and/or instructions of non-numeric cards that will adjust the numeric value of a player's cards. Once one player obtains the pre-determined total of points corresponding to the designated winning sum and has a winning combination of cards, that player wins and the game is over.

6 Claims, 9 Drawing Sheets

CARD GAME AND METHOD FOR PLAYING THE SAME

BACKGROUND OF THE INVENTION

1. Field of the Invention

The present invention relates to a card game. More particularly, the present invention relates to a card game having a series of cards including various numbers, pictures, and characters that, when combined, result in a sum total.

2. Description of the Related Art

Card games are considered by many to be enjoyable, educational, and pleasurable social activities. Many popular card games are designed to encourage strategic flexibility as well as test the nimbleness of each individual player. There is an element in the manner of play that generates delight of a player in a card game. For many players it is the perception of luck that is the driving force to play the game. Other players rely on the competitiveness and subsequent triumph as the driving force to play. For other players, the perceived level of skill to affect the outcome is key.

Various common cards games are played with a deck of 52 playing cards which typically includes thirteen ranks of each of four suits: clubs, diamonds, hearts, and spades, with "court" or face cards. Each suit includes an ace, depicting a single symbol of its suit, a king, queen, and jack, each depicted with a symbol of their suit; and ranks two through ten, with each card depicting that number of symbols of its suit. Common playing cards also carry index labels on opposite corners so that the card can be identified when held in a fan from left to right, regardless of which of the two narrow edges faces up. In addition to these traditional 52 cards, commercial decks often include between one and four jokers, most often two. These jokers are not used in most basic game rules, but have a variety of uses with rule variations, and can simply serve as "spares" to replace a damaged or lost card.

Card games are known which incorporate cards with numeric values in the playing of the game. Card playing games of this type include, for example, U.S. Pat. No. 8,328,197 B2, issued to Jones, which discloses a game of chance card game which the object of the game is for a player to successfully hold five cards whose total numeric value is higher than that of any of the other players or dealer at the end of the round.

Also, for example, U.S. Pat. No. 5,497,999, issued to Stewart et al., discloses a card playing game wherein each card in a deck is assigned any one of several different numeric values. The cards each have a given situation or problem on the front and a rule or solution on its rear. As the players follow the instructions on the cards, each player keeps track of their own cards and discards the cards when instructed.

Other card games are known which incorporate pictures and icons in the play of the game. For example, U.S. Pat. No. 6,651,984 B1, issued to Luken, discloses a deck of cards for playing a game of matching cards. Some of the cards have representations of the people, animals, objects, and symbols. As the players match cards, the first player to reach a certain point amount wins.

There appears to be a need for a card game that includes features related to calculation of numeric values and features related to performing operations based on a certain group of numeric or pictorial cards providing not only entertainment value to the players, but also encourages mental dexterity in the operation of playing the game. Thus, such a card game providing the aforementioned features is desired.

SUMMARY OF THE INVENTION

Embodiments of apparatuses include various sets of cards and also embodiments include methods for playing a card game with a set of cards, each of the cards has a front and a back, the set of cards including a plurality of cards having a plurality of sub-sets of cards, the cards from each sub-set displaying a numeric value, a pictorial icon, a number of characters, or both a numeric value and a pictorial icon, wherein a sum total of the cards in a player's hand is based on the numeric value of cards and one or more operations of cards which can change the sum total of cards in a player's hand.

In embodiments, each card of the various sub-sets of cards has a front face bearing a numeric value, a pictorial icon, a number of characters, or a both a numeric value and a pictorial icon. The cards of the various sub-sets of cards also have a back face, the back face can include a blank face or can also bear a numeric value, a pictorial icon, a number of characters, or a both a numeric value and a pictorial icon, for example.

An objective of the game, for example, is to obtain a sum total based on the calculation of numeric value of cards and operation of cards which can change the sum total of cards in a player's hand. Scoring is accomplished by adding the total sum of all the numeric cards of one distinct sub-set of cards and adjusting that total sum by an operation of one or more cards from one or more sub-sets of cards. A player to reach the designated winning sum is the winner and the game ends.

In embodiments, for example, to begin a method in the play of the game, the cards are shuffled and cards are dealt to each player including the dealer. The remainder of the cards is placed in the center of the players and is known as the withdrawing deck.

The dealer initiates the game, although the players may select any player for this purpose, including the player who won a previous game. The first player has a choice of discarding cards from the player's hand in a discard pile. If the player selects to discard any cards, the player must obtain the same number of cards that were discarded, from the withdrawing deck. The player may only discard and withdraw cards once per the player's turn.

If there is an instance in which the cards in the withdrawing deck are exhausted, a player or any player selected for this purpose may shuffle the cards in the discard deck and place it in the location of the previous withdrawing deck. This deck is now the current withdrawing deck. The player that created the new withdrawing deck can then take one card from the withdrawing deck and place it in a location near the withdrawing deck. This can be the new discard pile.

After the player re-establishes his or her personal set of cards or maintains his or her current set of cards, the player can then calculate the total sum value in his or her hand based on the cards as represented in his or her hand from various sub-sets of cards.

If the player does not have the winning sum, the player may selectively implement any card in the player's possession whose operation can affect the value or arrangement of one or more cards in one or more other player's hands.

After a player has been determined to have a non-winning sum, the rotation or turn is moved to a next player as the current designated player. The current designated player then has the opportunity to discard cards, withdraw new cards or maintain the same cards in the player's possession for attempting to obtain a winning sum.

Play continues, for example, by each player selectively determining whether to discard one or more cards and, if discarding one or more cards, to then withdraw a corresponding number of one or more new cards, implementing card operations, and attempting to obtain the whining sum during the player's turn of play. The game continues in this fashion until one player obtains the winning sum and declares it.

When a player obtains the winning sum and a winning combination of cards, he or she can say "it" or another agreed upon signal. That player is deemed the winner, the other players are no longer able to win, and the game is over.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

With reference now to the drawings, in particular to FIGS. 1 to 8 thereof, apparatuses and methods for a card game embodying features, principles and concepts of various embodiments of the card game will be described.

Figure 1:
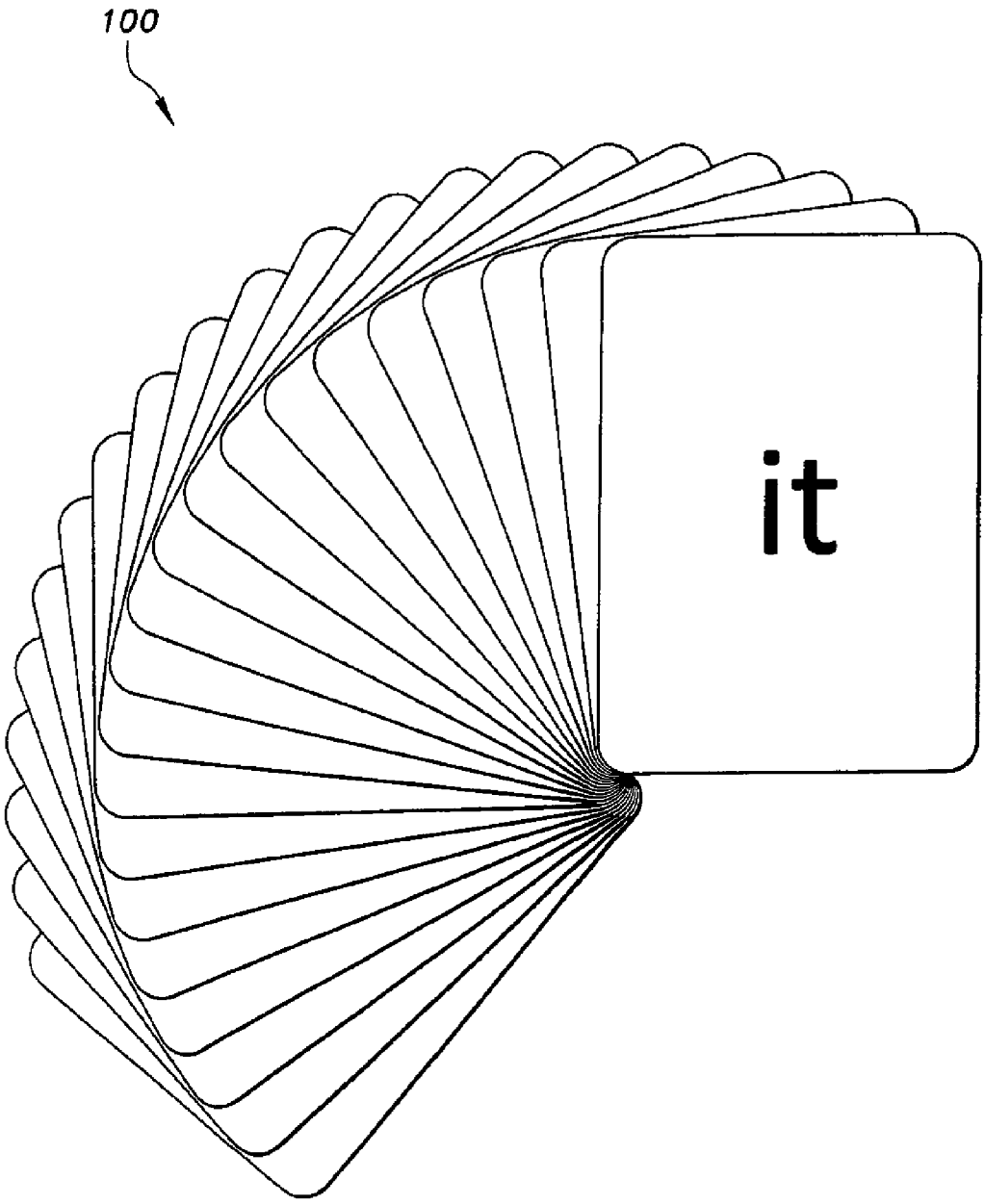
FIG. 1 is a top plan view of a plurality of cards used in embodiments of the card game, with the front face of one card exposed to illustrate features thereof according to the present invention.

Referring to FIG. 1, there is illustrated a card game including an exemplary deck of cards 100. The card game using the deck of cards 100 is an exciting and fun game geared toward using a variety of numbers, pictures, and characters to result in a sum amount. The various embodiments shown are for illustrative and simplicity purposes, but should not be construed in a limiting sense, in that the various embodiments are not limited to the illustrations shown, and additional numbers, pictures, or characters may be represented or used in the card game. The card game played with the deck of cards 100 is an interactive game that involves player participation and attention to detail. The game cards of the card deck 100 are configured to encourage arithmetic agility, logic analysis, and increased concentration from the players, for example.

The distinct cards of the card deck 100 include various distinct sub-sets of cards used in the card game, as illustrated in the sub-sets 200-500 of FIGS. 2-5, for example, with each sub-set of cards having a distinct set of cards. The cards from each sub-set of cards correspond to various functions, operations, or arithmetic calculations used in playing the card game. In embodiments, for example, once a player achieves a winning sum total of a predetermined or designated numeric value and has a winning combination of cards using the cards in the player's hand, based on one or more calculations, functions or operations of cards in the player's hand, that player wins the game and the game is over. In various embodiments, the predetermined numeric value of the winning sum can be 9, but other designated values for the predetermined numeric value of the winning sum can be used and is not limited in this regard. In order to win the card game, the player must adhere and follow the rules of the game accordingly. Exemplary rules for playing the card game are presented in Table I, but should not be construed in a limiting sense in that players may add, delete or change one or more of the rules to play the card game.

TABLE I

| Basic Rules of Play | |
|---|---|
| Rule 1: | The set of cards includes a plurality of cards. For example, the number of cards in the set of cards is one hundred and two (102). |
| Rule 2: | There can be a plurality of players involved in the card game. For purposes of illustration and simplicity, the typical range of the players can be from two to eight players but is not limited in this regard. |
| Rule 3: | Cards are distinguished as four groups, with each group having a different visual representation. A first group of cards display a numeric representation, a second group display a pictorial representation, a third group display a character representation, and a fourth group display a combination of both a numeric and pictorial representation. |
| Rule 4: | There is a dealer. For purposes of illustration and simplicity, the dealer will be a human dealer. |
| Rule 5: | Each player is given a pre-determined number of cards. For purposes of illustration and simplicity, the number of cards to be dealt to each player will be five. |
| Rule 6: | After each player is given a pre-determined number of cards, the remaining cards are placed in a stack. This stack will be the cards that a player will draw from when the player discards any unwanted cards in their possession. |
| Rule 7: | Any discarded cards by players will be placed in a separate discard stack. |
| Rule 8: | The dealer is the player that starts the game. |
| Rule 9: | At the applicable player's turn, the player can discard any card that the player does not intend to keep into a discard deck and withdraw a new card from the drawing deck. |
| Rule 10: | Players cannot swap cards freely without instruction from a card ordering a card swap. |
| Rule 11: | Once the drawing deck does not have any remaining cards, the cards in the discard deck are shuffled and used for continuation of game play. |
| Rule 12: | Players must follow the instruction or direction of a select card or cards in the player's hand based, such as based on a Card Value and Operation Chart (Table II) that explains the card's operation. |
| Rule 13: | Players must follow the instruction or directions of another player's card or cards that can be implemented against their own cards. |
| Rule 14: | Once a player determines the cards in the player's hand form a non-winning hand, that player's turn is over, and the rotation moves to the next player. |
| Rule 15: | If a player has a plurality of cards with multiple operations, the player can perform the operations in an order of an operation that operates on a solitary card and can then perform an operation of a card that operates on a plurality of cards. |
| Rule 16: | In order for a player to win, a player must collect a pre-determined or designated winning sum. In addition to the pre-determined sum the player must also have a winning combination of cards, a pre-determined number of cards and at least one of the cards must be |

TABLE I-continued

| Basic Rules of Play |
|---|
| from the first sub-set of cards representing a numeric value. For example, a player must collect a sum having a numeric value of nine from five cards with at least one of the five cards having a numeric representation thereon. |
| Rule 17: The game ends once a player wins. |

Accordingly, in playing the game, the game can include the card deck 100 having, for example, one hundred and two (102) cards (but can have more or fewer cards) forming the card deck 100, and should not be construed in a limiting sense. Each card in the card deck 100 can have on a face, such as on the card's front face, a number, picture, character, or combination thereof. The card deck 100 includes a plurality of sub-sets of cards, the cards from each sub-set distinctly displaying a numeric value, a pictorial icon, a number of characters, or a both a numeric value and a pictorial icon, for example.

Figure 2:
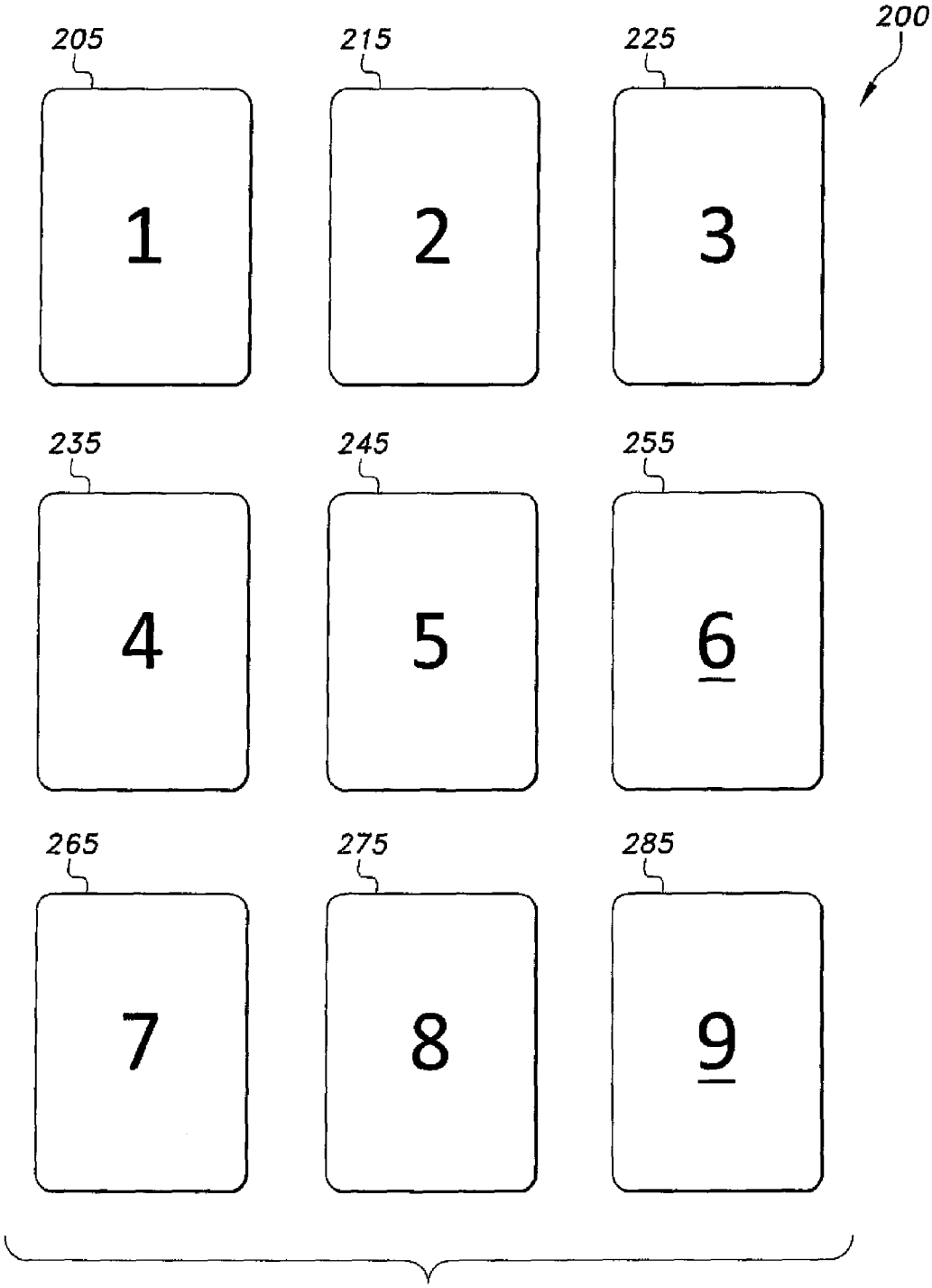
FIG. 2 is a front view of a front face of a first sub-set of cards with numeric values of one through nine according to the present invention.

Referring to FIG. 2, a distinct first sub-set of cards 200 is illustrated with a range of cards 205-285, for example. Each card in the first sub-set of cards 200 displays a number which is also the card's numeric value of points, and the number of cards and their numeric value in the first sub-set of cards 200 should not be construed in a limiting sense. The numeric values illustrated on the cards 205-285 in FIG. 2 are, for example: the numeric value "1" on the one card 205, the numeric value "2" on the two card 215, the numeric value "3" on the three card 225, the numeric value "4" on the four card 235, the numeric value "5" on the five card 245, the numeric value "6" on the six card 255, the numeric value "7" on the seven card 265, the numeric value "8" on the eight card 275, and the numeric value "9" on the nine card 285, respectively.

Figure 3:
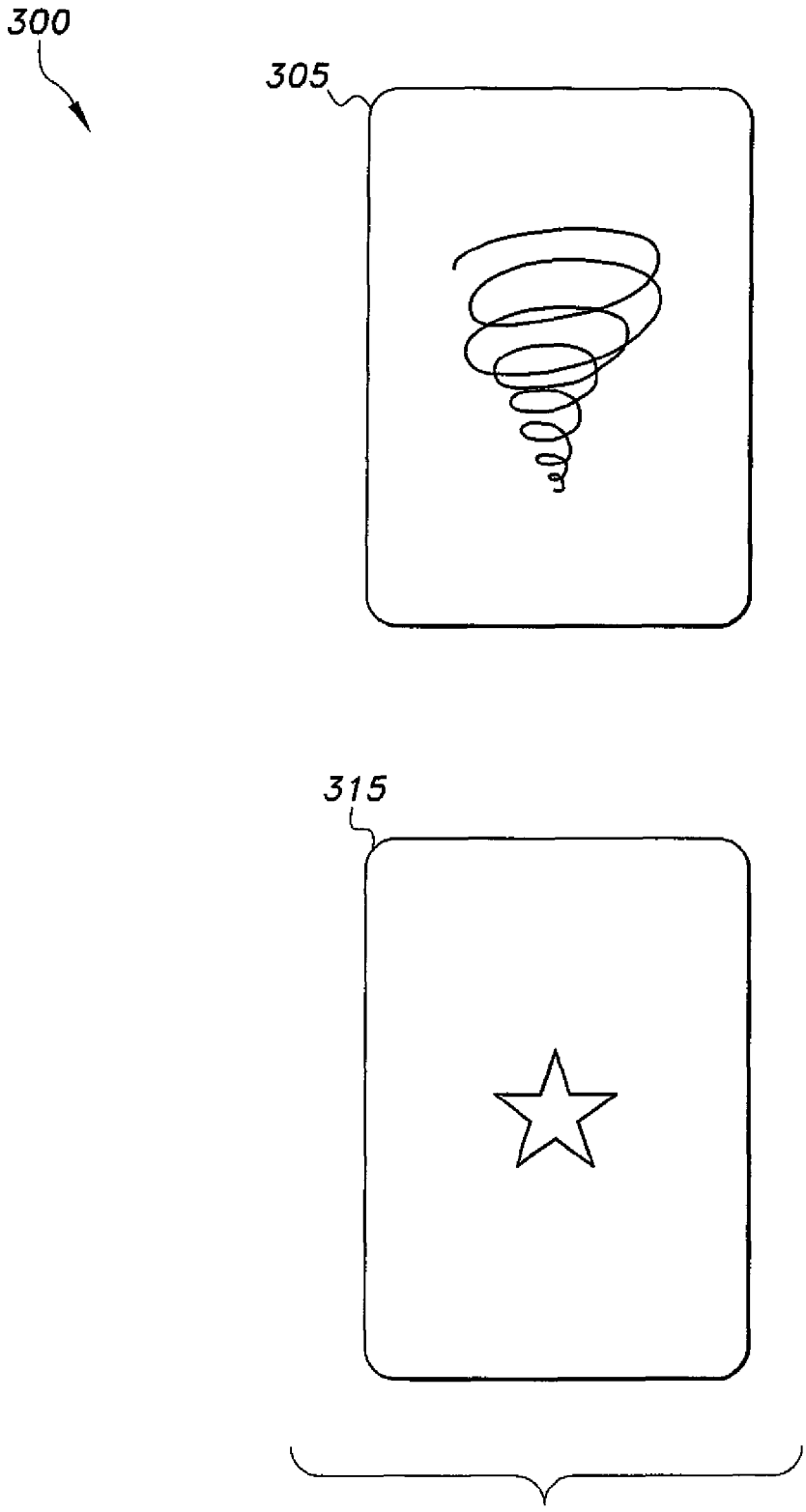
FIG. 3 is a front view of a front face of a second sub-set of cards depicting pictorial representations of a tornado and a star according to the present invention.

Referring to FIG. 3, a distinct second sub-set of cards 300 is illustrated in FIG. 3 and includes a tornado card 305 including a pictorial display of a tornado and includes a star card 315 including a pictorial display of a star, for example. Also, the number of cards included in the second sub-set of cards 300 and the depictions thereon should not be construed in a limiting sense.

Figure 4:
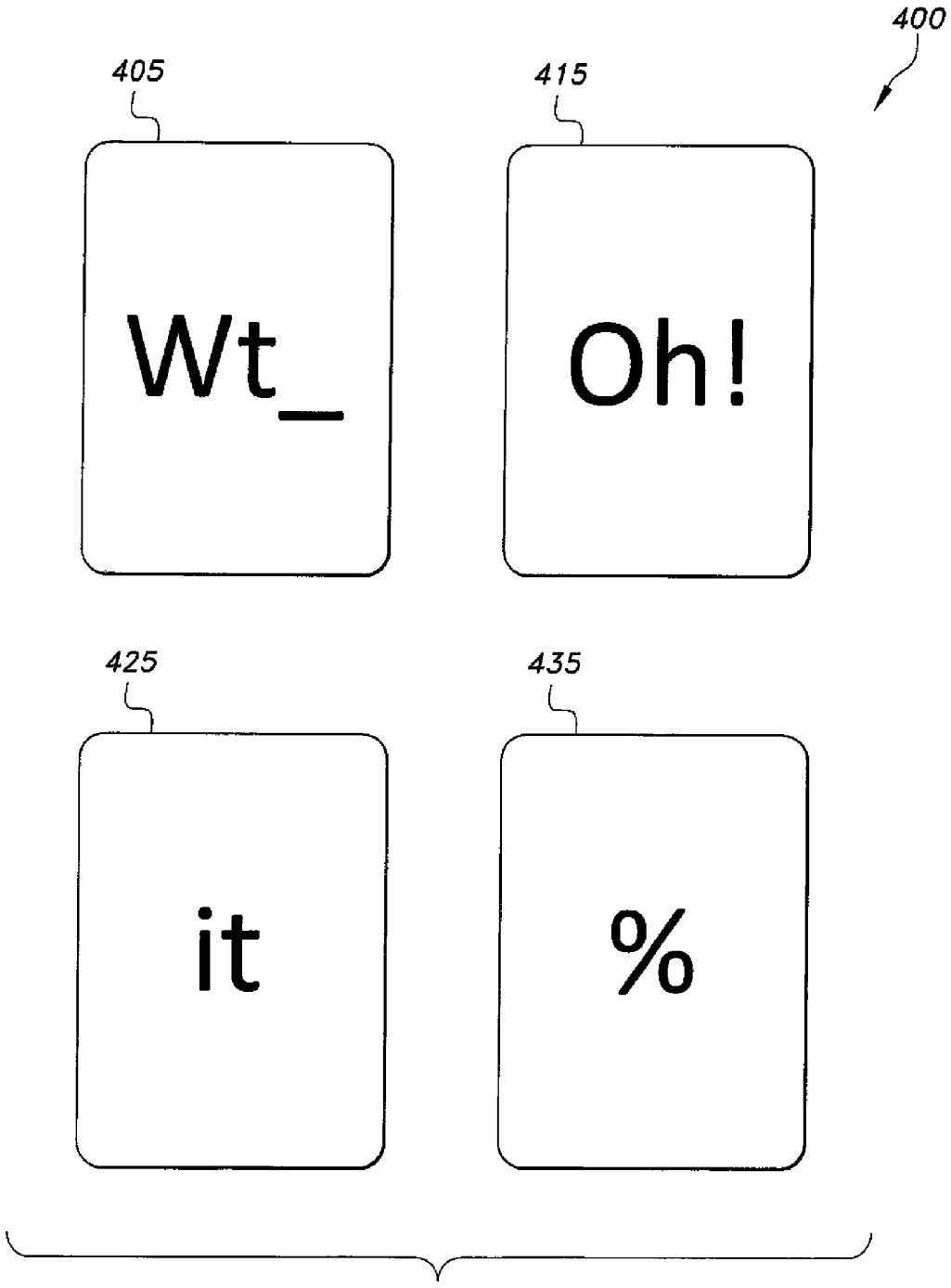
FIG. 4 is a front view of front face of a third sub-set of cards displaying special characters, such as "Wt_", "Oh!", "it", and "%" according to the present invention.

Referring to FIG. 4, a distinct third sub-set of cards 400 is illustrated in FIG. 4 and includes various character displays as, for example: the character display "Wt_" on the "Wt_" card 405, the character display "Oh!" on the "Oh!" card 415, the character display "it" on the "it" card 425, and the character display "%" on the "%" card 435, and the cards in the third-sub set 400 can include one or more characters displayed thereon in any arrangement. Also, the number of cards in the third sub-set of cards 400 and the characters thereon should not be construed in a limiting sense.

Figure 5:
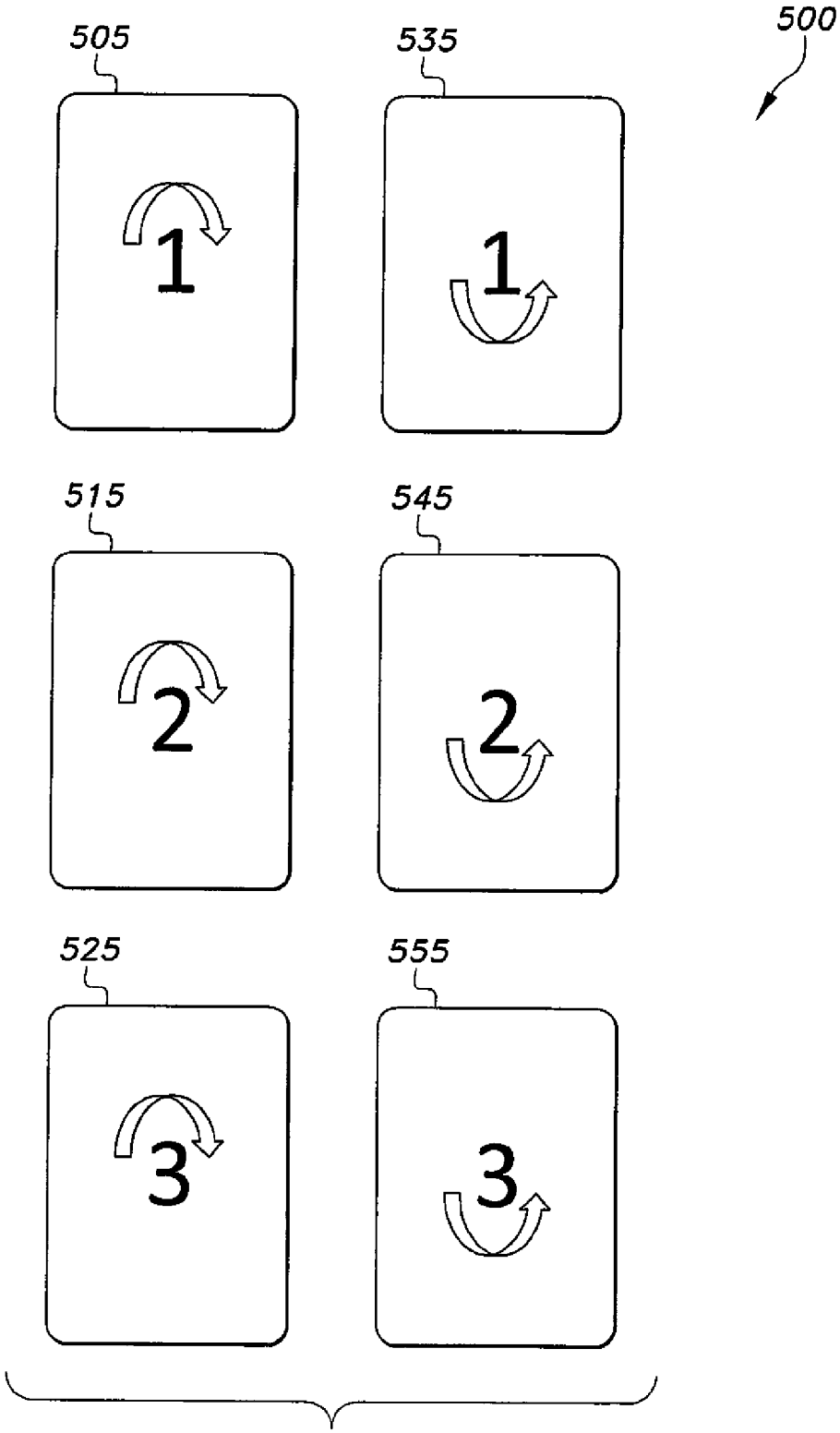
FIG. 5 a front view of a front face of a fourth sub-set of cards exhibiting both a numeric value and a pictorial representation, such as numeric value one ("1") with an overhead arrow or numeric value three ("3") with an arrow beneath, according to the present invention.

Referring to FIG. 5, a distinct fourth sub-set of cards 500 is illustrated in FIG. 5 and includes various cards with both a numeric value and a pictorial display, such as illustrated variations of an arrow as, for example: a number one ("1") with an arrow overhead on the numeric-pictorial card 505, a number two ("2") with an arrow overhead on the numeric-pictorial card 515, a number three ("3") with an arrow overhead on the numeric-pictorial card 525, a number one ("1") with an arrow underneath on the numeric-pictorial card 535, a number two ("2") with an arrow underneath on the numeric-pictorial card 545, and a number three ("3") with an arrow underneath on the numeric-pictorial card 555. Also, the number of cards and the numeric and pictorial depictions thereon in the fourth sub-set of cards 500 should not be construed in a limiting sense.

In the first sub-set of cards 200, the numeric cards with numbers of one to nine can have six copies of each card in the card deck 100, for example. The cards in the second, third, and fourth sub sets of cards 300, 400 and 500 with a pictorial representation, special character, or combination of a numeric value and pictorial representation can have four copies of each card, for example. Each subset in the card deck 100 is distinct and separate from another sub-set of cards. Each card in each sub-set of cards 200, 300, 400, and 500 are distinct and separate from another card in the same sub-set. In order to play the card game, a player must calculate or sum the values of the cards in the player's hand and selectively apply various operation cards as may affect the numeric value or sum of one or more of the cards in one or more player's hands. Examples of card values and operations thereon are illustrated in Table II, but should not be construed in a limiting sense:

TABLE II

Card Value and Operation Chart

| Numeric value, pictorial, character or numeric-pictorial displayed on card | Value or operation |
|---|---|
| 1 | The numeric value of points accredited to the card is one. |
| 2 | The numeric value accredited to the card is two. |
| 3 | The numeric value of points accredited to the card is three. |
| 4 | The numeric value of points accredited to the card is four. |
| 5 | The numeric value of points accredited to the card is five. |
| 6 | The numeric value of points accredited to the card is six. |
| 7 | The numeric value of points accredited to the card is seven. |
| 8 | The numeric value of points accredited to the card is eight. |
| 9 | The numeric value of points accredited to the card is nine. |
| tornado card | If a player implements this card, all players should drop one card. The player who implemented the tornado card should collect all the cards, shuffle them and then distribute all the cards between the players including the tornado card owner. |
| star card | This card equals to a point value of at least zero points and can be used by a player if the player has the winning sum total in the player's remaining cards. |
| "Wt_" | It is a card that prevents a player from winning, even if the player has a winning sum in the player's remaining cards. |
| "Oh!" | If a player has one or more of the "Oh!" card, this card may switch a point value from a first numeric value to a second numeric value of a select number of cards. For example, if a player has one "Oh!" card, the card switches a numeric card 6 to a numeric value of 9 points or switches the numeric card 9 to a numeric value of 6 points, but is not limited in this regard to only such cards.<br>If a player has two "Oh!" cards, then the cards have no power to switch and equal nothing.<br>If a player has 3 "Oh!" cards, then it switches all the player's number 6 cards to 9s and all the player's number 9 cards to 6s, for example.<br>If a player has 4 "Oh!" cards, the cards have no power if the last numeric value card is a 6 or a 9, for example.<br>If a player has an "Oh!" card and doesn't have a 9 or a 6 card, for example, the player can attempt to discard the "Oh!" card as it will not equal zero or may not help the player to win. |
| "it" | A card that can be used as a wild card and can represent a numeric value, greater than or equal to zero, as selected by the player. |
| "%" | A card that changes the sum of the numeric value of points of all the cards in the player's possession by a predetermined percentage, such as by doubling the sum. |
| a number "1" with an arrow overhead | A card that decreases a value of points of any numeric card in the player's possession by one. |

TABLE II-continued

| Card Value and Operation Chart | |
|---|---|
| Numeric value, pictorial, character or numeric-pictorial displayed on card | Value or operation |
| a number "2" with an arrow overhead | A card that decreases a value of points of any numeric card in the player's possession by two. |
| a number "3" with an arrow overhead | A card that decreases a value of points of any numeric card in the player's possession by three. |
| a number "1" with an arrow underneath | A card that increases a value of points of any numeric card in the player's possession by one. |
| a number "2" with an arrow underneath | A card that increases a value of points of any numeric card in the player's possession by two. |
| a number "3" with an arrow underneath | A card that increases a value of points of any numeric card in the player's possession by three. |

Figure 6:
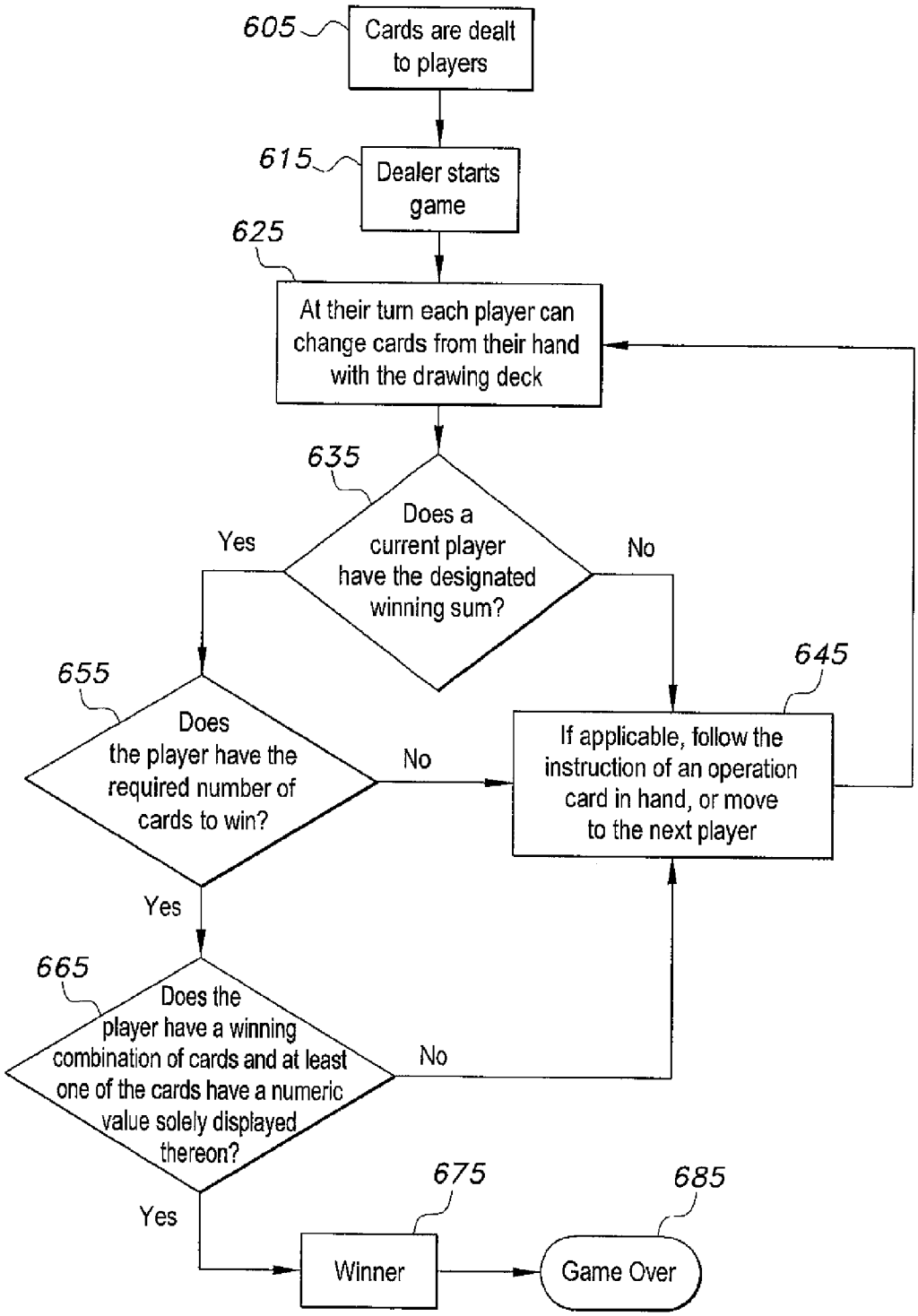
FIG. 6 is a flowchart illustrating embodiments of methods for playing the card game according to the present invention.

Referring now to FIG. 6, various embodiments of methods for playing the card game are described schematically with respect to FIG. 6 using the card deck 100.

An objective of the card game is to obtain a winning sum total of points based on the calculation of a numeric value of the points of the cards and based on operations of cards which can change the sum total of the points in a player's hand. Players must attempt to obtain a numeric sum total of points, as may be agreed by all players, for example, in order to win the game. Various cards in the card deck 100 can have a point value or numeric value of and including zero (0) points. The set of cards can include 102 cards, with 4 card sub-sets, as discussed, that are used in calculating a sum amount. However, unlike a standard deck of cards, which incorporates a set range of cards and no card typically performing an operation on another card, the card deck 100 can have an open range for cards and can include cards that can alter the numeric value of one or more cards in a player's hand by various operations or functions.

In examples of various methods for playing the card game, scoring is accomplished by adding the total sum of all the numeric cards of one sub-set of cards and adjusting that total sum by an operation of one or more cards from one or more sub-sets of cards. A player to reach the designated winning sum and a winning combination of cards, based on the cards from the sub-sets in the player's hand, is the winner and the game ends.

For example, after the set of cards of the card deck 100 are shuffled, the dealer deals out five cards from the card deck 100 to each player at step 605, and the remainder of the cards from the card deck 100 are placed in the convenient location in relation to the players to form the withdrawing deck. The dealer can take one card from the withdrawing deck and place it beside the withdrawing deck. This is called the discard pile.

The dealer or other selected player initiates the game at step 615. Any player may be selected to initiate the game at step 615, including the player who won a previous game. Once the game is initiated at step 615, the game can be played in a clockwise rotation, but is not limited in this regard.

The current player in rotation has the option of discarding cards from his or her hand into the discard pile and picking up the same number of cards from the withdrawing deck that were discarded at step 625. The player may only discard and withdraw cards once per the player's turn. After the player either maintains the player's current set of five cards or replaces the discarded cards from the withdrawing deck to again have a hand of a set of five cards, the player can then calculate the total sum value in the player's hand based on the cards from the one or more sub-sets represented in the player's hand at step 635.

If there is an instance in which the cards in the withdrawing deck are exhausted, a current player, or any player selected for this purpose, may shuffle the cards in the discard deck and place it in the location of the previous withdrawing deck. This deck is now the current withdrawing deck. The player that created the new withdrawing deck can then take one card from the withdrawing deck and place it in a location near the withdrawing deck. This can be the new discard pile.

If the current player does not have the winning sum at step 635, the play proceeds to step 645. At step 645, the player may selectively implement any card in the player's possession whose operation can affect the value or arrangement of one or more cards in one or more players' hands. At step 645, after any selective implementation of any card in the player's possession to perform an operation to affect the value or arrangement of one or more cards in one or more players' hands, the rotation or turn is moved and the play continues at step 625 to a next player as the current designated player and the play proceeds as discussed. The current designated player then has the opportunity to discard cards and then withdraw new cards or maintain the same cards in the player's possession for attempting to obtain a winning sum.

However, if the player at step 635 is determined to have the winning sum, the player must check to ensure he or she meets the additional requirements of having the required number of cards in the player's hand to win the game at step 655, such as a total of five cards in his or her possession. If so, the play then proceeds to step 665, where the player determines whether at least one of the winning total of cards, such as five cards, in the player's possession is a card having a numeric value and the card is from the first sub-set of cards 200.

If the current player meets the criteria of having the winning sum at step 635, and has the required number of cards, e.g., five cards, in the player's possession at step 655, and the player has a winning combination of cards and at least one of the player's required cards, e.g., one of the five cards, is of a numeric value and is from the first sub-set of cards 200 at step 665, then the play proceeds to step 675 and the player wins the game and the game is then over at step 685. Otherwise, play continues at step 645, wherein the player follows the instruction of an applicable card in the player's hand, for example, by a player selectively determining whether to discard one or more cards and withdraw a corresponding one or more new cards, implement card operations, or attempting to obtain the winning sum during the player's turn of play, or the play moves to a next current player. The game continues in this fashion until one player obtains the winning sum. When a player obtains the winning sum, he or she can say "it" or another agreed upon signal. That player is deemed the winner, the other players are no longer able to win, and the game is over.

The following example illustrates playing the card game among a plurality of players, and should not be construed in a limiting sense. In this regard, for example, the dealer (player 1) deals five cards to player 2, player 3 and dealer (player 1), respectively at step 605. Player 1 looks at the cards in player 1's possession, and, in this instance, decides to discard three cards into the discard deck, and to take three cards from the withdrawing deck at step 625. The cards in player 1's possession are now the following cards: the one card 205, the two card 215, the nine card 285, the "%" card 435, and the star card 315. Player 1, at step 635, then looks at the cards in his possession, calculates the sum total points according to the card values, such as in Table II, and determines the sum value of points of the cards totals twenty-four. As player 1 does not have any cards in player 1's possession that could interact with the other players at step 645, player 1's turns ends and player 2 is then current designated player.

Player 2, as the current designated player, was dealt the following cards: the nine card 285, the numeric-pictorial card 535 having the number one with an arrow underneath, the numeric-pictorial card 555 having the number three with an arrow underneath, the "it" card 425, and the "%" card 435. Player 2 looks at the cards in player 2's possession, calculates the sum total of points of the cards according to the card values in Table II, and determines the numeric value of the points of the cards total at least twenty-six (the value could be more depending on the numeric value player 2 assigns the "it" card 425).

Player 2 then decides to keep the "it" card 425, discard the other four cards into the discard deck, and take four cards from the withdrawing deck at step 625. The cards in player 2's hand are now the "it" card 425, the six card 255, an "Oh!" card 415, the three card 225, and a star card 315. According to the card values, such as in Table II, the sum total of points of the cards now of player 2's cards is at least twelve (the value could be more depending on the numeric value player 2 assigns the "it" card 425). Calculating the basic numeric values of the three card 225 and the six card 255, i.e. 6+3, gives player 2 the initial sum total of points of at least 9 (which is the winning sum total in this example), but the "Oh!" card's 415 operation changes the numeric value of the points of the number six card from 6 points to 9 points. Thus, the calculated new numeric total of player 2's points by operation the "Oh!" card 415, is 9+3 and is at least 12 points (the value could be more depending on the numeric value player 2 assigns the "it" card 425). Since player 2 does not have the designated winning sum, e.g. of nine points, and does not have a card player 2 can use against another player, player 2's turn ends and player 3 is now the current designated player at step 645.

Player 3, as the current designated player, looks at the cards in player 3's possession, and decides to discard two cards into the discard deck, and take two cards from the withdrawing deck at step 625. The cards now in player 3's possession are the five card 245, the seven card 265, the eight card 275, the "%" card 435, and the tornado card 305. Player 3 looks at the cards in player 3's possession, calculates the sum total of points of the cards according to the card values, such as in Table II, and determines the cards total forty points (the "%" card 435 changed by a predetermined percentage, e.g., doubled in this example, the total sum of the points of all the cards in player 3's hand). Although player 3 does not have the winning sum, player 3 can select to use the tornado card 305, such as according to Table II, and make every player, including player 3, drop one card from each player's hand and then player 3 redistributes the dropped cards among all the players at step 645. After player 3 uses the tornado card 305 and redistributes some cards among all the players or decides not to implement the tornado card 305, player 3's turn is over and player 1 is the current designated player in the rotation again at step 645.

Figure 7:
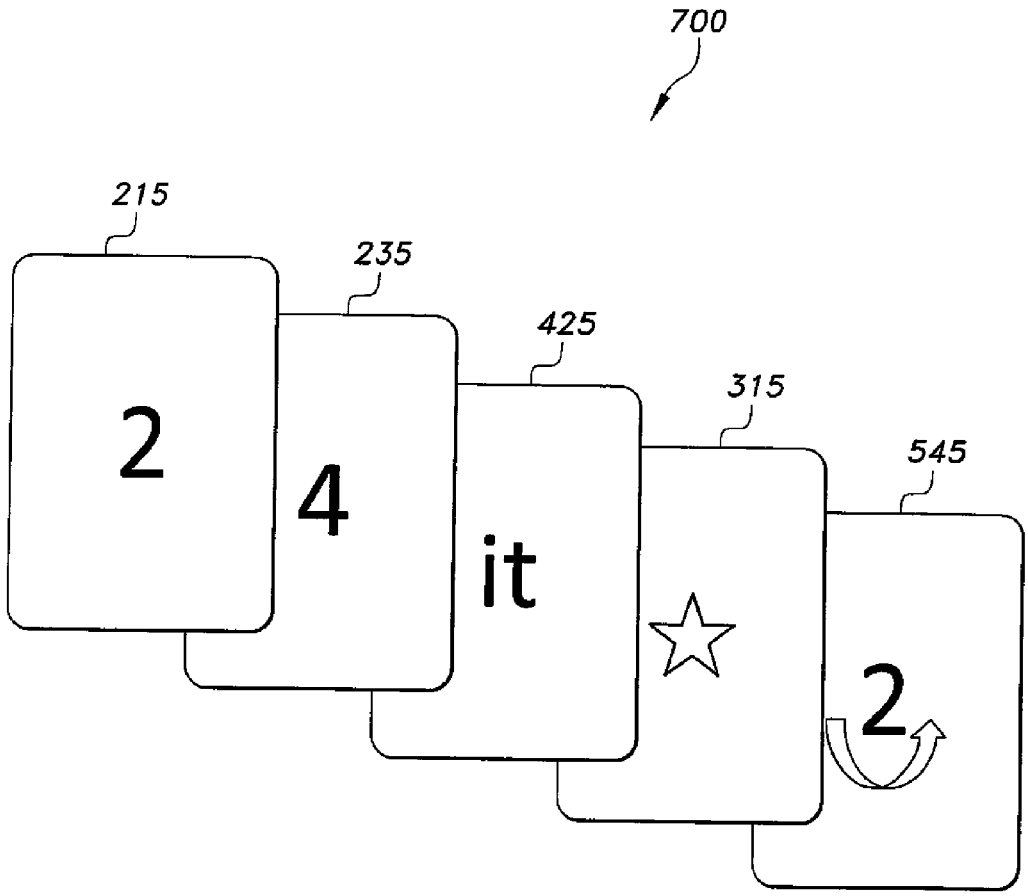
FIG. 7 is a front view of the front faces of cards of an exemplary winning hand including a winning combination of cards showing at least one card from one or more sub-sets of cards involved in playing the card game according to the present invention.

As the current designated player, the cards in player 1's possession are still the one card 205, the two card 215, the nine card 285, the "%" card 435, and the star card 315. Player 1 looks at the cards in player 1's possession, and decides to discard three cards into the discard deck, and take three cards from the withdrawing deck at step 625. The cards now in player 1's possession are the cards shown in FIG. 7 in the hand 700, for example. As illustrated in FIG. 7, player 1 now has the two card 215, the four card 235, the "it" 425, the star card 315, and numeric-pictorial card 545 having the number two with an arrow underneath. Player 1 looks at the cards in player 1's possession, calculates the sum total of the points of the cards according to the card values, such as in Table II, and determines the sum total of the points of the cards totals the designated winning sum, e.g., nine points in this example, if player 1 assigns a numeric value of one to the "it" card 425. After confirming the calculation that player 1 has the winning sum of points at step 635, player 1 confirms he or she has the required number of cards, e.g., five cards in this example, at step 655, and verifies at least one of player 1's cards is a card from the first sub-set 200 with a numeric value and determines the player has a winning combination of cards at step 665. Player 1 then proceeds to win the card game at step 675 and the game ends at step 685.

Figure 8:
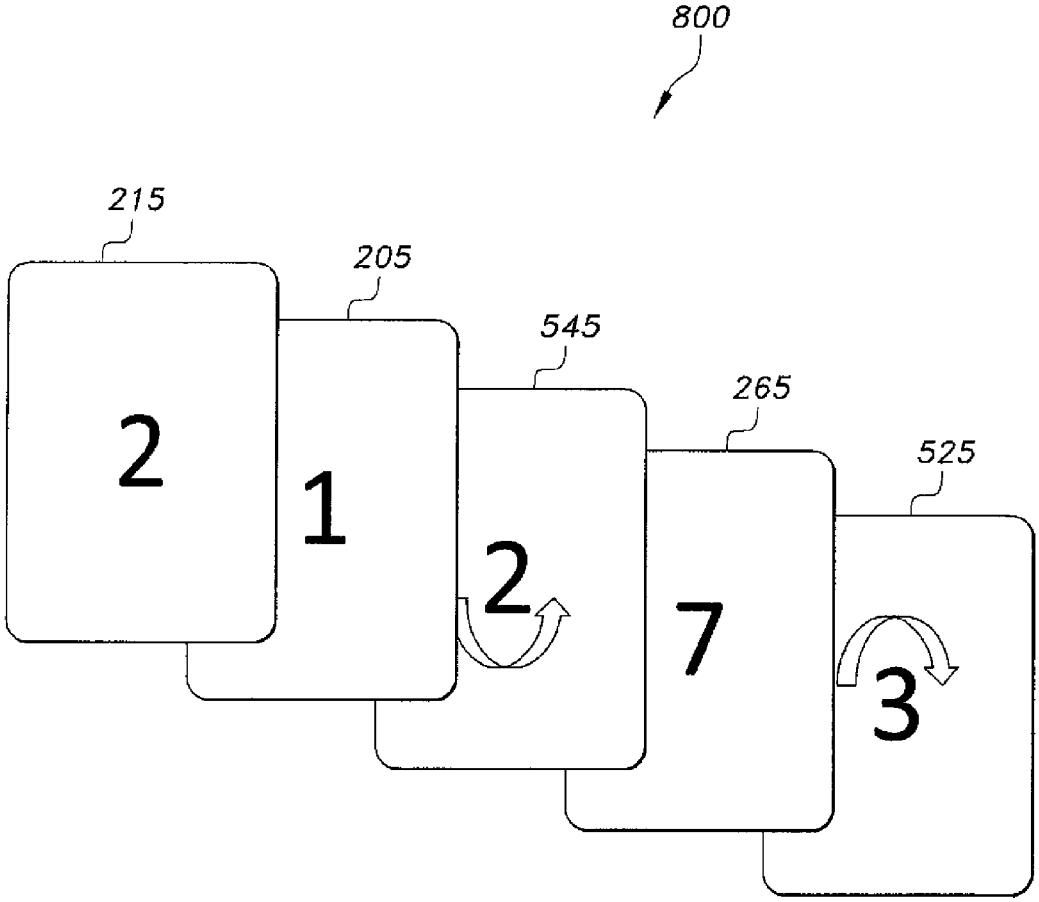
FIG. 8 is a front view of the front faces of cards of another exemplary winning hand including a winning combination of cards showing at least one card from one or more sub-sets of cards involved in playing the card game according to the present invention.

FIG. 8 illustrates the front faces of cards of another exemplary winning hand including a winning combination of cards having a winning sum showing at least one card from one or more sub-sets of cards involved in playing the card game. As illustrated in FIG. 8, the hand 800 includes the two card 215, the one card 205, numeric-pictorial card 545 having the number two ("2") with an arrow underneath, the seven card 265, and the numeric-pictorial card 525 having the number three ("3") with an arrow overhead.

For example, a player looks at the cards 800 in the player's and calculates the sum total of the points of the cards according to the card values, such as in Table II, and determines the sum total of the points of the cards totals the designated winning sum, e.g., nine points in this example, after the player includes in the determination of the sum the operation of the numeric-pictorial card 545 that increases the value of points of any numeric card in the player's hand 800 by two points and the operation of the numeric-pictorial card 525 that decreases the value of points of any numeric card in the player's hand 800 by three points, for example. After confirming the calculation that the player in the hand 800 has the winning sum of points at step 635, the player confirms he has the required number of cards, e.g., five cards in this example, at step 655, and verifies at least one of player's cards is a card from the first sub-set 200 with a numeric value and determines the player has a winning combination of cards at step 665. Therefore, since the hand 800 is determined to be a winning hand, the player can then proceed to win the card game at step 675 and the game ends at step 685.

Although embodiments has been described in terms of a set of cards, it will be appreciated that embodiments of the card game and methods for playing the card game can be applied to a computer game in which various sub-sets of cards and the instructions for playing the card game can be stored in a memory of and can be implemented by a computer implemented device, as well as the game and the cards of the game can be generated by the computer implemented device and can be displayed as images on a digital screen associated with the computer implemented device, such as a computer. The set of cards can therefore also be a set of virtual "cards" in such embodiments and the computer application includes hardware, such as can include processors and memory, and software for adapting and implementing the processes and methods of FIG. 6 as an example of an algorithm in a computer-implemented application in playing the card game.

For example, when cards are dealt in a computer or digital game, one player may be human and one player may be the computer itself. The human player may interact with the computer player as the human player would with any other player. In addition to interacting with the computer player, the human player may also interact with various other players in various locations through a networking system, such as a local or global computer communication system.

Figure 9:
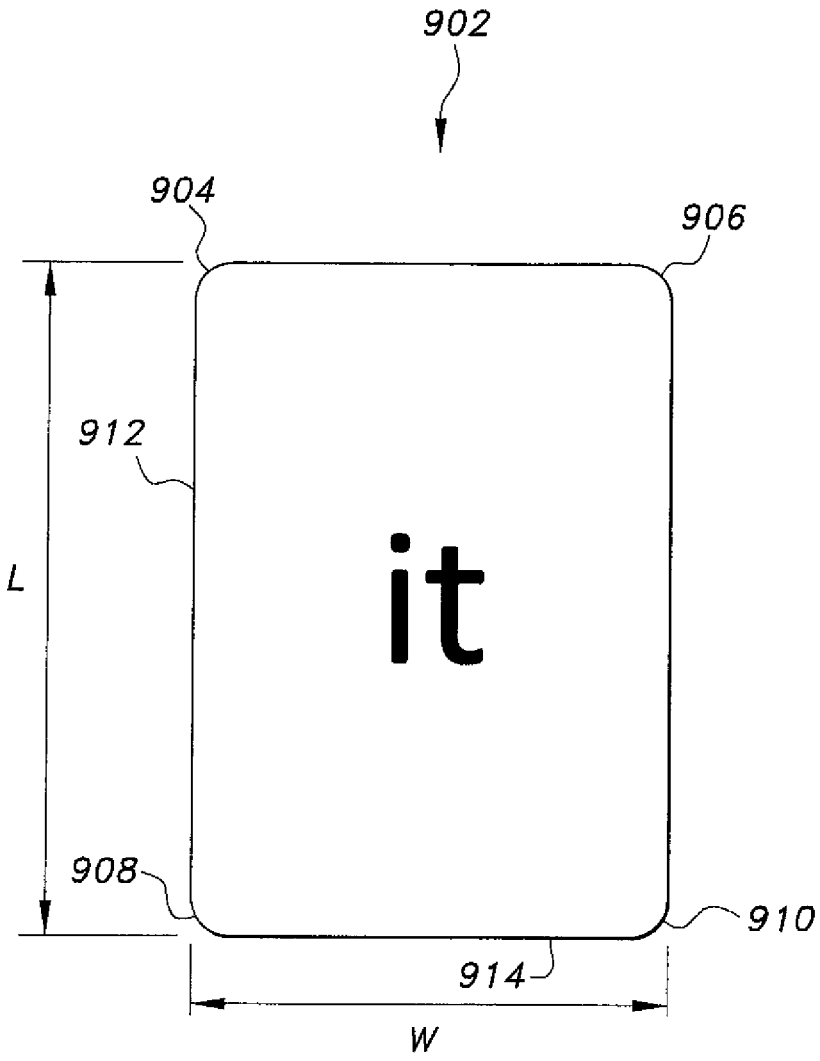
FIG. 9 is a front view of an exemplary card from the set of cards showing a card with rounded edges in the set of cards according to the present invention.

Also, referring to FIG. 9 an example of a card 902 of card deck 100 of FIG. 1 is illustrated. The card 902 can be any suitable size, such as card of a size having a side 914 of a width W of about 2.5 inches and a side 912 of a length L of about 3.5 inches, for example, although the size of the card should not be construed in a limiting sense. Further, the corners 904, 906, 908 and 910 of the card 902 can be of various shapes, such as rounded corners or corners of a generally rounded shape, such as illustrated in FIG. 9, for example. The cards in the card deck 100, such as card 902, can be formed to include any suitable material, such as from a paper material, a plastic material, a tile material, or a metal material. Each card in the card deck 100 can have a flat surface in which to display the card's numeric value, picture, character, or combination thereof. Additionally, the size of indicia on the front face or the size of indicia on the back face of the card, such as card 902, the indicia including, for example, the numeric value, pictorial representation, character representation, or combination thereof, as displayed on a card from the card deck 100, can be one or more different sizes, a variety of sizes or of a same size, for example.

Therefore, embodiments of the card game provide game apparatuses and methods for playing a card game which is relatively simple and versatile so that players of various ages and levels of gamesmanship may enjoy the card game and benefit therefrom.

Further, embodiments of the card game provide a versatile card game that can be played through a variety of different methods, such as paper cards, digital & computer mediums, tiles and the like.

It is to be understood that the present invention is not limited to the embodiments described above, but encompasses any and all embodiments within the scope of the following claims.

I claim:

1. A card game, comprising:

a distinct set of cards, the set of cards comprising:

a distinct first sub-set of cards, each card of the first sub-set of cards having a numeric value displayed thereon, the numeric value displayed on the first sub-set of cards indicates a numeric value of points, a distinct second sub-set of cards, each card of the second sub-set of cards having a pictorial representation displayed thereon, the pictorial representation displayed on the second sub-set of cards indicates an operation to exchange one or more cards or to maintain the sum of the numeric value of points of one or more cards from the first sub-set of cards, a distinct third sub-set of cards, each card of the third sub-set of cards having a character representation displayed thereon, the character representation displayed on the third sub-set of cards includes one or more cards that indicate an operation to change a numeric value of points of one or more cards, and a distinct fourth sub-set of cards, each card of the fourth sub-set of cards having both a numeric value and a pictorial representation displayed thereon, the numeric and pictorial representation displayed on the fourth sub-set of cards indicates an operation to change a numeric value of points of a card in the first sub-set of cards.

2. The card game according to claim 1, wherein:

the numeric value displayed on the first sub-set of cards indicates a numeric value of points assigned to a corresponding card in the first sub-set of cards, the pictorial representation displayed on the second sub-set of cards indicates an operation to swap at least one card from each of one or more players of the card game or an operation that does not contribute to a collective numeric point value of one or more cards, the character representation displayed on the third sub-set of cards includes one or more cards that indicate an operation to change an individual point value or a collective point value of one or more cards or an operation to assign one or more cards a numeric point value, and the numeric and pictorial representation displayed on the fourth sub-set of cards indicates an operation to change a numeric point value of a selected card in the first sub-set of cards to decrease or increase the numeric point value of the selected card in the first sub-set of cards by a number of points.

3. The card game according to claim 1, wherein:

the first sub-set of cards indicates a numeric value of points assigned to a corresponding card in the first sub-set of cards, the numeric value of points for the cards of the first sub-set of cards being greater than or equal to one point;

the second sub-set of cards includes:

a card that indicates an operation to swap at least one card from each of one or more players of the card game; and a card that includes a numeric value of at least zero points;

the third sub-set of cards includes:

a card that indicates an operation to cause a card of the first sub set of cards having a first numeric value to switch to a second numeric value or a card with the second numeric value to switch to the first numeric value;

a card that indicates an operation to prevent a player from winning the card game;

a card which indicates an operation to adjust the numeric sum of the point value of all the cards in a player's possession; and a card which indicates an operation to assign itself a selected numeric point value; and the fourth sub-set of cards includes:

a card with a numeric value and a pictorial representation which indicates an operation to add a numeric point value displayed on the card to a card in the first sub-set of cards in the player's possession or to subtract the numeric point value displayed on the card from a card in the first sub-set of cards in the player's possession.

4. The card game according to claim 1, wherein:

the first sub-set of cards includes:

a plurality of distinct cards each card having a numeric value displayed thereon indicating a numeric value of points of a corresponding card in the first sub-set of cards, the points displayed being in a range of from at least one point through nine points;

the second sub-set of cards includes:

a distinct card with a pictorial representation of a tornado that indicates an operation to swap at least one card from each of one or more players of the card game; and a distinct card with a pictorial representation of a star that indicates the card with the pictorial representation of the star has a value of at least zero points;

the third sub-set of cards includes:

a distinct "Oh!" card that indicates an operation to cause a card in the player's possession with a first numeric value of points to switch to a second numeric value of points;

a distinct "Wt_" card which indicates an operation to prevent a player from winning the card game;

a distinct "%" card which indicates an operation to change by a predetermined percentage the numeric value of points of the cards of the player in possession of the card; and a distinct "it" card which indicates an operation to assign itself a selected numeric point value; and the fourth sub-set of cards includes:

a plurality of distinct cards with a numeric point value and a pictorial representation displayed thereon indicating an operation to add the numeric point value displayed on the card to a card in the first sub-set of cards in the player's possession or subtract the numeric point value displayed on the card from a card in the first sub-set of cards in the player's possession.

5. A method for playing a card game, the method comprising the steps of:

executing, with a processor, a program stored in a memory of a computer implemented device, the program directing the computer implemented device to perform the following:

(a) generating a distinct set of cards by the computer implemented device, the set of cards including a distinct first sub-set of cards with each card of the first sub-set of cards having a numeric point value displayed thereon, a distinct second sub-set of cards with each card of the second sub-set of cards having a pictorial representation displayed thereon, a distinct third sub-set of cards with each card of the third sub-set of cards having a character representation displayed thereon, and a distinct fourth sub-set of cards with each card of the fourth sub-set of cards having both a numeric point value and a pictorial representation displayed thereon;

(b) designating a winning sum for a player to win the card game;

(c) designating a player to initiate the game;

(d) dealing a plurality of cards of a preset number from the set of cards to each player to form an initial hand;

(e) forming a withdrawing deck from the remaining cards of the set of cards after the preset number of cards has been dealt to each player;

(f) requiring a decision of a designated player to determine whether to discard one or more unwanted cards in the designated player's hand into a discard deck at a turn of the designated player and, when it is determined to discard the one or more unwanted cards, executing the decision of the designated player and discarding the one or more cards and withdrawing a number of cards from the withdrawing deck corresponding to the number of discarded cards and assigning the withdrawn number of cards to the designated player;

(g) determining a sum of the numeric point value of one or more cards from the first sub-set of cards in the designated player's hand and, when included in the designated player's hand, including in the determining of the sum of the numeric point value one or more operations of one or more cards other than the first sub-set of cards in the designated player's hand, and determining based thereon whether the designated player has the designated winning sum, and, when it is determined the designated player has the designated winning sum, determining whether a winning combination of cards is in the designated player's hand;

(h) when it is determined the designated player's hand does not include the designated winning sum or does not include a winning combination of cards, requiring a decision by the designated player to selectively determine to play a card from other than the first sub-set of cards when present in the designated player's hand, wherein the card designates an operation to be performed on one or more cards in one or more player's hands;

(i) moving the rotation to a next player as the designated player after determining a previous designated player's hand does not include the designated winning sum or does not include a winning combination of cards;

(j) converting the discard deck of cards into the withdrawing deck when no card remains in the withdrawing deck; and (k) executing steps (f) through (j) until it is determined the cards of a current designated player's hand have the designated winning sum and have a winning combination of cards.

6. The method according to claim 5, wherein:

the first sub-set of cards includes:

a plurality of distinct cards each card having a numeric value displayed thereon indicating a numeric value of points of a corresponding card in the first sub-set of cards, the points displayed being in a range of from at least one point through nine points;

the second sub-set of cards includes:

a distinct card with a pictorial representation of a tornado that indicates an operation to swap at least one card from each of one or more players of the card game; and a distinct card with a pictorial representation of a star that indicates the card with the pictorial representation of the star has a numeric value of at least zero points;

the third sub-set of cards includes:

a distinct "Oh!" card that indicates an operation to cause a card in the player's possession with a first numeric value of points to switch to a second numeric value of points;

a distinct "Wt_" card which indicates an operation to prevent a player from winning the card game;

a distinct "%" card which indicates an operation to change by a predetermined percentage the numeric value of points of the cards of the player in possession of the card; and a distinct "it" card which indicates an operation to assign itself a selected numeric point value; and the fourth sub-set of cards includes:

a plurality of distinct cards with a numeric point value and a pictorial representation displayed thereon indicating an operation to add the numeric point value displayed on the card to a card in the first sub-set of cards in the player's possession or subtract the numeric point value displayed on the card from a card in the first sub-set of cards in the player's possession.

* * * * *